United States Patent [19]

Armer, Jr. et al.

[11] Patent Number: 4,690,061

[45] Date of Patent: Sep. 1, 1987

[54] LAND MINE FOR USE IN A SIMULATED WAR GAME

[76] Inventors: Leon N. Armer, Jr., 22 Utica St., Brockport, N.Y. 14420; Joseph M. Antonio, 151 Rosecroft Dr.; Craig A. Roth, 241 Haviland Pk., both of Rochester, N.Y. 14616; James R. VerWeire, 48 Ogden Ctr. Rd., Spencerport, N.Y. 14559

[21] Appl. No.: 800,203

[22] Filed: Nov. 21, 1985

[51] Int. Cl.[4] ..... F42B 23/22

[52] U.S. Cl. ..... 102/401; 102/367; 102/407; 102/502

[58] Field of Search ..... 102/401, 407, 513, 366, 102/367, 334, 502; 273/380; 446/4–6

[56] References Cited

U.S. PATENT DOCUMENTS

| | | | |
|---|---|---|---|
| 2,475,008 | 7/1949 | Catherwood, Jr. | 102/401 |
| 3,156,187 | 11/1964 | Batou | 102/498 X |
| 3,564,756 | 2/1971 | Yokoi | 446/4 |
| 3,709,148 | 1/1973 | Costley et al. | 102/407 |
| 3,791,303 | 2/1974 | Sweeney et al. | 102/502 |
| 4,034,497 | 7/1977 | Yanda | 102/367 |

FOREIGN PATENT DOCUMENTS

| | | | |
|---|---|---|---|
| 2345336 | 3/1975 | Fed. Rep. of Germany | 102/401 |

*Primary Examiner*—Deborah L. Kyle
*Assistant Examiner*—Ted L. Parr
*Attorney, Agent, or Firm*—Lawrence P. Kessler

[57] ABSTRACT

A weapon for use in a simulated war game which has the characteristics of a land mine and therefore does not require the user to be in proximity to a target when the weapon is activated. The weapon includes a housing having a first chamber adapted to contain a slurry of a marking agent and dispersing agent. A second chamber, communicating with the first chamber, is adapted to contain a propelling agent such as a cylinder of compressed gas for example. A trigger mechanism is operatively associated with an activator for the propelling agent to actuate the activator when the trigger mechanism is tripped. When the activator is actuated, the propellant is released into the first chamber to drive the slurry from such chamber through an opening into an exterior receptacle, which in turn directs the slurry in a desired pattern exteriorly of the housing.

4 Claims, 7 Drawing Figures

FIG. 4
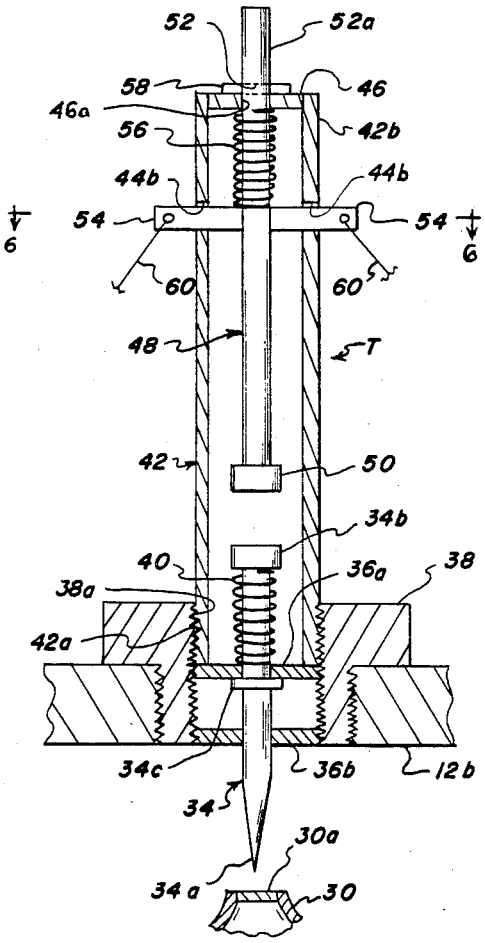
FIG. 5
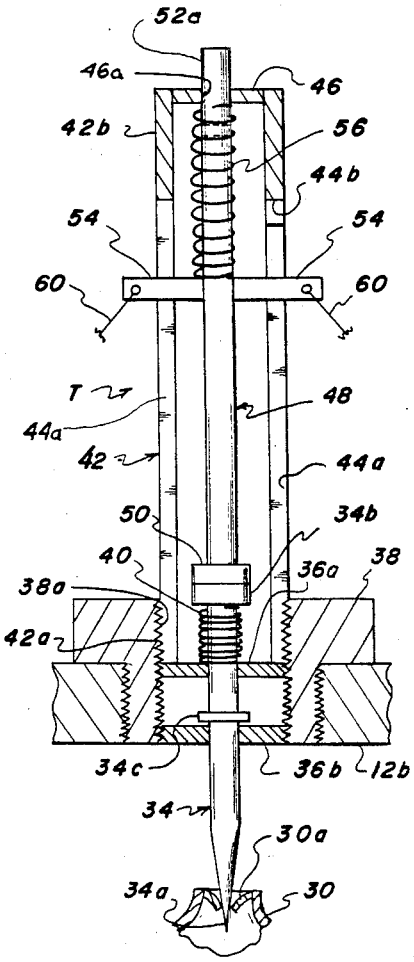
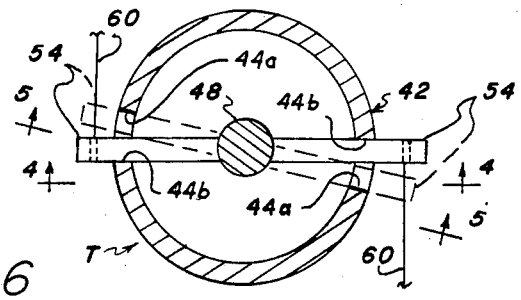
FIG. 6

LAND MINE FOR USE IN A SIMULATED WAR GAME

BACKGROUND OF THE INVENTION

This invention relates generally to weapons for use in simulated war games, and more particularly to a war game weapon having the characteristics of a land mine.

Simulated war games have long been used for the purpose of training military personnel in the use of weapons and strategic combat tactics. Recently, however, simulated war games have become a popular recreational outlet for non-military personnel. Such games are played with weapons that utilize a colorant or paint cartridge for example. The colorant is directed by the weapon against a target such as opposing personnel. When the colorant strikes the target or such opposing personnel, that target or person is identified by the colorant as being eliminated from the game.

Simulated war game weapons in use today are typically air guns which propel the colorant in a substantially straight line trajectory. Another type of weapon is described in our copending U.S. patent application Ser. No. 773,442 filed 9/6/85. Such weapon emulates a grenade; that is, a colorant is hand delivered against a target typically out of direct line of sight. As can be readily appreciated, both the air guns and the grenade type weapons require a positive and physical action by a user in proximity to a target. The user is therefore potentially exposed to his opponent and subject to return fire.

SUMMARY OF THE INVENTION

This invention is directed to a weapon for use in a simulated war game which has the characteristics of a land mine and therefore does not require the user to be in proximity to a target when the weapon is activated. The weapon includes a housing having a first chamber adapted to contain a slurry of a marking agent and dispersing agent. A second chamber, communicating with the first chamber, is adapted to contain a propelling agent such as a cylinder of compressed gas for example. A trigger mechanism is operatively associated with an activator for the propelling agent to actuate the activator when the trigger mechanism is tripped. When the activator is actuated, the propellant is released into the first chamber to drive the slurry from such chamber through an opening into an exterior receptacle, which in turn directs the slurry in a desired pattern exteriorly of the housing.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 4 is side elevational view, partly in cross-section and on an enlarged scale, of the trigger mechanism and propellant activator of this weapon in their armed position;

FIG. 5 is view similar to FIG. 4 showing the trigger mechanism and activator in firing position;

FIG. 6 is a cross-sectional plan view of the trigger mechanism taken on lines 6—6 of FIG. 4.

DESCRIPTION OF THE PREFERRED EMBODIMENTS

Figure 1:
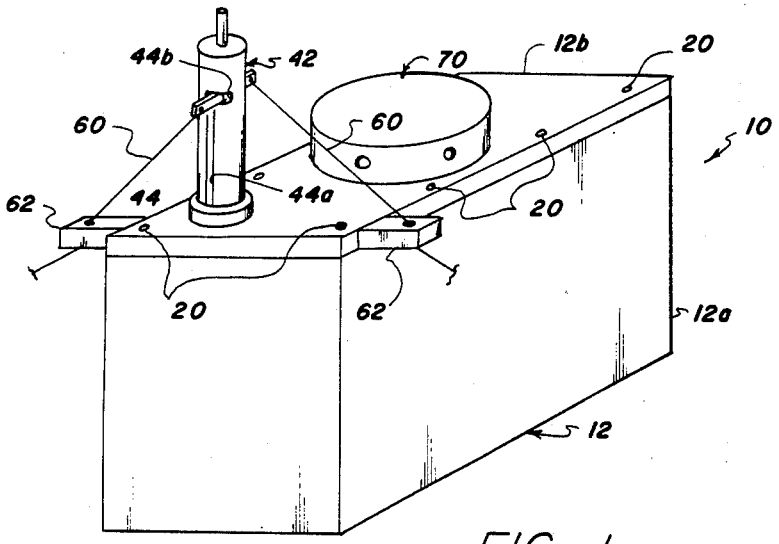
FIG. 1 is a view, in perspective, of the weapon exhibiting the characteristics of a land mine according to this invention.
Figure 3:
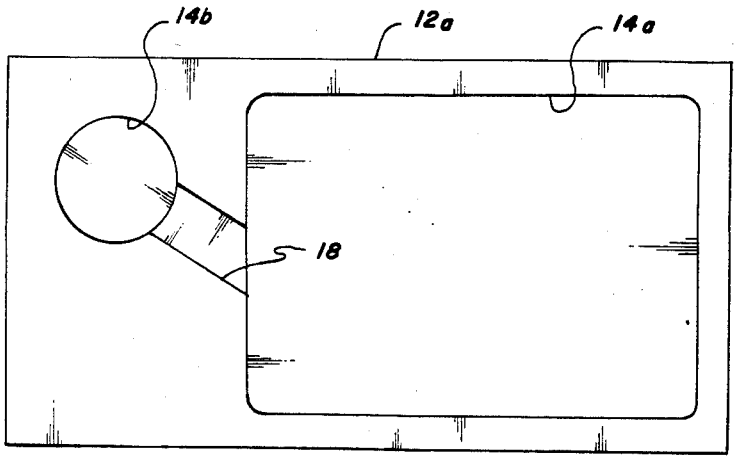
FIG. 3 is a sectional top plan view, on an enlarged scale, of the the housing of this weapon taken along lines 3—3 of FIG. 2.
Figure 2:
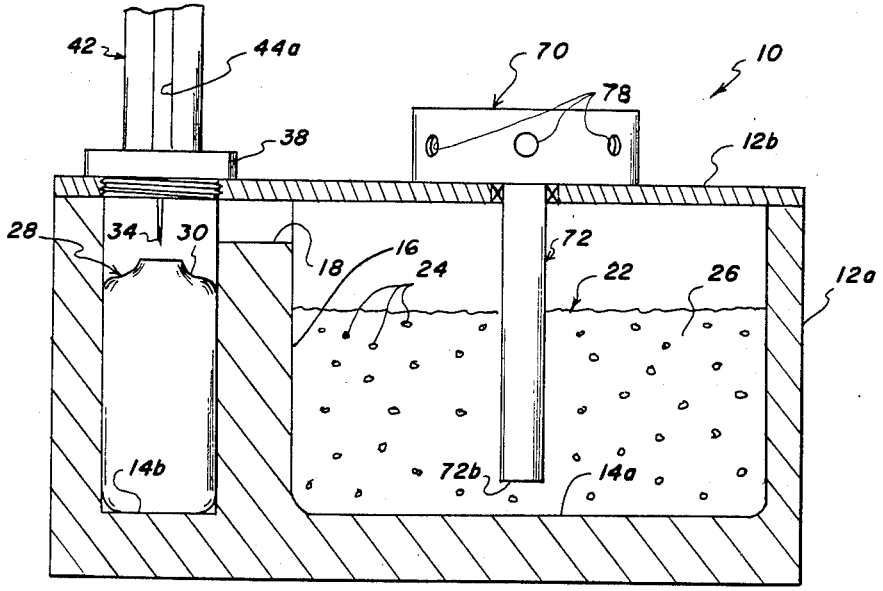
FIG. 2 is a side elevational view, partly in cross-section and on an enlarged scale, of the weapon of FIG. 1 according to this invention with portions removed or broken away to facilitate viewing.
Figure 7:
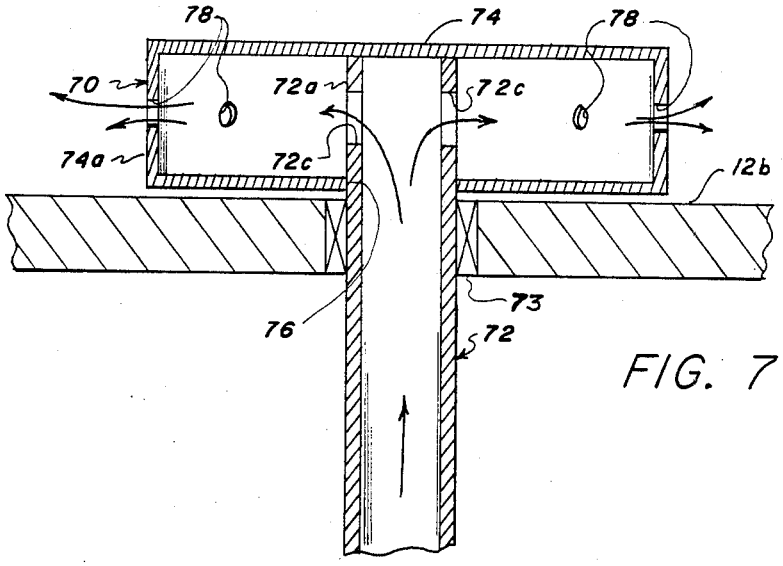
FIG. 7 is a side elevational view, in cross section and on an enlarged scale, of the slurry-directing receptacle of this weapon.

Referring now to the accompanying drawings, FIGS. 1 and 2 show a weapon, designated generally by the numeral 10, exhibiting the characteristics of a land mine according to this invention. The weapon 10 includes a housing 12 having a body portion **12*a* and a sealing cover 12*b*. The body portion 12*a* includes a first chamber 14*a* and a second chamber 14*b* separated by a wall 16 having a port 18 providing flow communication between the chambers. The body portion 12*a* is, for example, an epoxy material molded to integrally form the chambers, dividing wall and flow port (see FIG. 3). The sealing cover 12*b* is removably attached to the body portion 12*a* of the housing by suitable fasteners such as screws 20 for example. The removability of the cover 12*b* is desirable to provide ready access to the chambers 14*a*, 14*b*** for the purpose of supplying a personnel identifying colorant and a colorant propellant respectively.

The personnel colorant, adapted to be contained in chamber **14*a*, is a slurry 22 comprising a marking agent 24 and a dispersing agent 26. The marking agent 24 is rock dust for example; and the dispersing agent 26 is water. The combination of water and rock dust is in a ratio by weight of approximately 1 to 1, for example. Accordingly, the slurry is non-toxic, washable and biodegradable. It is therefore safe for use in a simulated war game without harming the environment or subjecting personnel to potentially hazardous material. The propellant, adapted to be contained in chamber 14*b*, is for example a cylinder 30 of compressed gas such as $C0_2$ having a rupturable seal 30*a* at one end thereof. The chamber 14*b* is configured so that the seal 30*a* of the cylinder is held in a precise location. As noted above, the cover 12*b* is removable to enable the slurry 22 and the propellant cylinder 30 to be supplied to the chambers 14*a* and 14*b*** respectively.

An activator 34 is provided to effect the action of the propellant in the manner described hereinbelow. The activator 34 is an elongated member retained and slidably supported in bearings **36*a*, 36*b* mounted in a bushing 38. The bushing 38 is carried by the cover 12*b* of the housing 12 in a location to align the activator with the seal 30*a* of the propellant cylinder 30. The elongated member of the activator 34, as best shown in FIGS. 4 and 5, has a pointed end 34*a* directed at the seal 30*a*, a flattened head 34*b* at the opposite end, and a stop flange 34*c* intermediate its ends. A compression spring 40 located between bearing 36*a* and head 34*b* urges the elongated member to an armed position of FIG. 4 where flange 34*c* engages the underside of bearing 36*a*. The pointed end 34*a* is adapted to rupture the seal 30*a* when the elongated member is depressed from its position of FIG. 4 to its position of FIG. 5 by engagement of the head 34*b*** by a trigger mechanism T.

The trigger mechanism T includes a tubular housing 42 engageable with the bushing 38 for support thereby. Such engagement may be effected, for example, by mating threads 42a and 38a enabling the housing 42 to be screwed into bushing 38 to seat on bearing 36a for accurate location of the mechanism T. The tubular housing 42 has a pair of L-shaped slots 44, the legs 44a thereof being parallel to the longitudinal axis of the housing and the legs 44b being substantially perpendicular to the legs 44a. The end 42b of the housing 42 has a closure 46 in which a bore 46a is defined. A striker member 48 is received in the housing 42. The striker member 48 has an elongated body with a hammer head 50 at one end, a portion 52a defining a hole 52 at the opposite end, and a pair of arms 54 extending radially from the body intermediate its ends. The location of the hole 52 is such that it is positioned immediately above the closure 46 when the arms 54 are positioned in the legs 44b of the slots 44. A compression spring 56, located between the closure 46 and the arms 54, urges the hammer head 50 of the striker member 48 toward the head 34b of the activator 34. Of course, the spring 56 could alternatively be a tension spring coupled between the arms 54 and a portion of the housing 42 substantially below the arms.

The operation of the trigger mechanism T is as follows: The striker member 48 is moved in the housing 42 against the urging of the spring 56 and rotated so that arms 54 are respectively positioned in legs 44b of the slots 44 (see solid line position of FIG. 6). A pin 58 is inserted in the hole 52 to prevent premature movement of the striker member during arming. The weapon 10 is located in a desired strategic area or area to be protected by the weapon, and trip wires 60 are connected to the arms 54 such as by being threaded through substantially horizontal eye members 62 extending from the housing 12 for example. The wires 60 are set to be tripped by an opponent entering the protected area and contacting the wires. The pin 58 is then removed and the weapon 10 assumes an armed state. Thereafter, when any of the wires 60 are tripped, the striker member 48 will be rotated so that arms 54 move in legs 44b of slots 44 to be aligned with legs 44a (see phantom line position of FIG. 6). The spring 56 is then free to urge the member 48 in a direction where the hammer head 50 will forceably engage the head 34b of the activator 34. In turn, the activator 34 moves in the direction where its pointed end 34a ruptures the seal 30a of the cylinder 30 to release the compressed gas from within the cylinder. If desired, a toy percussion cap may be placed between the hammer head 50 and the flattened head 34b, whereby forceable engagement therebetween fires the cap to give an audible signal that the weapon 10 has been set off. Of course, a radio control device coupled to the trigger mechanism T to rotate the striker member 48 is suitable for use with this invention.

When the activator 34 ruptures the seal 30a of cylinder 30, the compressed gas escapes and expands to pressurize the chamber 14b and (through port 18) chamber 14a. The pressure in chamber 14a acts on the slurry 22 to force the slurry from the chamber into an external receptacle 70 via a hollow tube 72. The tube 72 is mounted for rotation in a bearing 73 and extends through the cover 12b so as to have one end 72a external to the housing 12 and the opposite end 72b located just above the bottom of chamber 14a. The receptacle 70 includes a hollow body 74 having a bore 76 for receiving the end 72a of tube 72. The body 74 seats on the end 72a so that the receptacle 70 can be rotated with the tube for adjustment about the longitudinal axis of the tube. The tube has transverse openings 72c adjacent to the end 72a providing flow communication between the interior of the tube and the interior of the hollow body 74. The body 74, in turn, has a plurality of ports 78 extending through its exterior wall 74a. Accordingly, when the slurry 22 is subjected to pressure from the expanding gas of the propellant, it is forced into the tube 72 and then through openings 72c into the hollow body 74 of the receptacle 70. From the body the slurry is then expelled tnrough the ports 78 in a desired pattern outwardly of the weapon 10. Rotational adjustment of the receptacle 70 about the axis of the tube 72 determines the direction of the desired pattern of the expelled slurry to be most effective against a particular target.

In order to utilize the weapon 10, the cover 12b is removed and the chambers 14a and 14 are respectively loaded with a slurry 22 and a propellant 28 (compressed gas cylinder 30). The cover is replaced and the weapon is positioned in a strategic location, such as along an opponent's suspected travel path, or in proximity to an object to be protected such as a home base. The trigger mechanism T is then armed as described above, with the trip wires 60 located in a position likely to be contacted by an opponent, and the receptacle 70 is rotated to a position to effect an optimum desired pattern for expelled slurry. The wires and the weapon 10 may be camouflaged to prevent detection. When an opponent trips the wires 60, the trigger mechanism T will actuate the activator 34 in the manner described above and the slurry 22 will be expelled in a desired pattern from the weapon. Any of the slurry striking opponent thus marks that opponent as being eliminated from the simulated war game.

The invention has been described in detail with particular reference to preferred embodiment thereof, but it will be understood that variations and modifications can be effected within the spirit and scope of the invention.

We claim:

1. A weapon, for use in a simulated war game, exhibiting the characteristics of a land mine, said weapon comprising:

a housing, said housing defining first and second intercommunicating chambers, said first chamber being loadable with a slurry including a marking agent and a dispersing agent, and said second chamber being loadable with a slurry propellant;

means for activating a propellant loaded in said second chamber to enable such propellant to drivingly force a slurry loaded in said first chamber from said first chamber;

directing means, associated with said first chamber, for defining an exit flow path therefrom, said directing means including a receptacle, means for adjustably mounting said receptacle on the exterior of said housing adjacent to said first chamber, an opening defined in a wall of said housing between said first chamber and said receptacle enabling flow communication therebetween, and a plurality of openings defined in an exterior wall of said receptacle, whereby adjustment of said receptacle orients said openings in a desired direction; and a trigger mechanism operatively associated with said activating means for actuating said activating means.

2. The invention of claim 1 wherein said activating means includes a member movably supported in said housing adjacent to said second chamber, said member being responsive to said trigger mechanism to move into contact with a propellant container and on contact therewith to release such propellant; and wherein said trigger mechanism includes an elongated member, means for holding said elongated member in a first position remote from said member of said activating means and for moving said elongated member toward said member of said activating means for forceable engagement therewith, said holding and moving means including atubular housing extending from said weapon housing adjacent to said member of said activating means and within which said elongated member is located substantially along the longitudinal axis of the tubular housing, said tubular housing defining at least one slot having a first leg extending in a direction parallel to the longitudinal axis of said tubular housing and a second leg substantially perpendicular to said first leg, at least one arm connected to said elongated member and extending substantially radially therefrom through said slot, means for urging said elongated member in the longitudinal direction toward said member of said activating means, and means coupled to said arm for rotating said arm positioned in said second leg and held against longitudinal movement thereby into alignment with said first leg, whereby said elongated member is longitudinally movable by said urging means into engagement with said member of said activating means.

3. The invention of claim 2 wherein said means for rotating said arm includes a wire extending outwardly from said arm and adapted to be located in a position external of said weapon whereby movement of said wire by an external source effects rotation of said arm.

4. The invention of claim 1 wherein said mounting means is a hollow tube extending from the interior of said first chamber into said receptacle through said opening, said receptacle being seated on said tube, a bearing mounted in said wall of said housing in said opening and surrounding said hollow tube, whereby said receptacle and tube are rotatable about the longitudinal axis of said tube for adjustably orienting said receptacle openings in a desired direction.

* * * * *